US005103912A

United States Patent [19]

Flint

[11] Patent Number: 5,103,912

[45] Date of Patent: Apr. 14, 1992

[54] METHOD AND APPARATUS FOR COMPLETING DEVIATED AND HORIZONTAL WELLBORES

[76] Inventor: George R. Flint, 6118 Magnolia, Katy, Tex. 77493

[21] Appl. No.: 566,526

[22] Filed: Aug. 13, 1990

[51] Int. Cl.[5] ..... E21B 43/112; E21B 43/117

[52] U.S. Cl. ..... 166/297; 166/55; 166/373; 166/384; 175/4.52; 175/4.54; 175/4.55

[58] Field of Search ..... 166/297, 373, 276, 227, 166/228, 55, 55.1, 384; 175/4.52, 4.55, 4.54

[56] References Cited

U.S. PATENT DOCUMENTS

| | | | |
|---|---|---|---|
| 2,891,620 | 6/1959 | Bielstein | 166/297 |
| 3,031,965 | 5/1962 | Nelson | 166/55.1 |
| 3,032,104 | 5/1962 | O'Reilly | 166/297 |
| 3,036,634 | 5/1962 | Corley, Jr. | 166/297 |
| 3,612,189 | 10/1971 | Brooks et al. | 166/55.1 |
| 3,768,557 | 10/1973 | Spurlock et al. | 166/228 |
| 4,655,283 | 4/1987 | Pritchard, Jr. | 166/55.1 |
| 4,862,964 | 9/1989 | George et al. | 166/297 |
| 4,880,059 | 11/1989 | Brandell et al. | 166/332 |
| 4,901,802 | 2/1990 | George et al. | 166/297 |
| 4,917,183 | 4/1990 | Gaidry et al. | 166/228 |
| 4,917,189 | 4/1990 | George et al. | 166/297 |
| 4,949,788 | 8/1990 | Szarka et al. | 166/373 |

*Primary Examiner*—Stephen J. Novosad
*Attorney, Agent, or Firm*—Arnold, White & Durkee

[57] ABSTRACT

A method of completing a well is provided which utilizes a primary tool string and a secondary tool string. The primary tool string will include apparatus such as perforating guns and associated firing heads, and may be actuated to perforate the well. This primary tool string will also include various flow control mechanism, which will control the flow of fluid from the perforated formations into selected portions of the primary tool string. These flow control mechanisms are preferably actuated through use of a secondary tool string.

12 Claims, 4 Drawing Sheets

METHOD AND APPARATUS FOR COMPLETING DEVIATED AND HORIZONTAL WELLBORES

BACKGROUND OF INVENTION

The present invention relates generally to methods and apparatus for completing wells, such as oil and gas wells, and more specifically relates to methods and apparatus for completing multiple intervals in such wells. Methods and apparatus in accordance with the present invention are useful in most wells having multiple intervals requiring completion, but are believed to be of extreme benefit in highly deviated, or in so-called "horizontal", wells wherein multiple intervals will be completed in a single potential producing formation or "zone".

Currently, highly deviated or horizontal wells are typically completed by individually completing multiple individual intervals within the zone of interest along the length of the well. Conventional techniques for performing such completions typically include the perforating of the lowest interval in the well; the treating of that interval (such as by acidizing, fracturing, etc.), if necessary; and the subsequent killing of the interval to allow a repeat of the above sequence on the next highest interval in the well. In a common situation where tubing conveyed perforating guns are utilized to perforate the well, separate tubing conveyed perforating gun assemblies are typically run into the hole for perforating each interval. Such operations are not only extremely time consuming, requiring multiple trips of the tubing in and out of the well, but also often involve the killing of the lower perforated intervals by pumping fluid into the intervals, with potentially deleterious effects upon formation productivity.

Accordingly, the present invention provides a new method and apparatus whereby multiple intervals in a well may be perforated essentially simultaneously, and whereby each interval may be selectively either shut-in or isolated for treatment, eliminating the need to kill a perforated interval. Additionally, the present invention provides a new method and apparatus whereby multiple zones within a well may be completed with a minimal number of trips of tubing in and out of the borehole, and whereby snubbing tubing or coiled tubing may be used for many of these trips, thereby simplifying the equipment for the operation, and allowing the operation to be performed in an optimally short period of time.

SUMMARY OF THE INVENTION

The present invention provides a method of perforating multiple intervals in a well through use of a primary tool string having a bottom hole assembly thereon, and through use of a secondary tool string. In a particularly preferred embodiment, the bottom hole assembly includes a packer assembly such as a conventional permanent packer, and a plurality of perforating gun assemblies. In one preferred embodiment, each perforating gun assembly includes a branching block coupled to the tubing string to establish a parallel equipment string in fluid communication with the interior of the tubing string. These preferred embodiments of perforating gun assemblies also include a perforating gun in the parallel tubing string, which perforating gun has appropriate firing heads associated therewith. In one particularly preferred embodiment, the perforating gun will have a tubing pressure actuated firing head in fluid communication with the tubing string, and will also have an annulus pressure actuated firing head, to provide redundant firing systems for the perforating gun. Additionally, in this preferred embodiment, the tubing string will be in fluid communication with the annulus exterior of the bottom hole assembly, most preferably this fluid communication will exist below the lowermost perforating gun assembly. In one preferred embodiment, this primary tool string will also include at least one isolation packer disposed in the tool string between adjacent perforating gun assemblies to provide isolation of the annuli around at least two such assemblies and to provide isolation of intervals perforated by those perforating guns of the individual assemblies.

In a preferred method of practicing the present invention, after the primary tool string is disposed within the well, the packer assembly will be set to isolate an upper portion of the wellbore from a lower portion of the wellbore surrounding the bottom hole assembly. Once this isolation is achieved, pressure may be applied to the interior of the tubing string to actuate the perforating guns, which perforating guns will be detonated essentially simultaneously. In one preferred embodiment, wherein the tool string includes isolation packers, after actuation of the perforating guns and flowing of the well for a selected period, one or more isolation packers may be set to achieve the described isolation of intervals. Thereafter, intervals may be selectively opened to flow, either by actuation of a flow control valve, or by perforating a section of the bottom hole assembly, to allow fluid flow into the tubing string.

DETAILED DESCRIPTION OF THE PREFERRED EMBODIMENTS

Figures 1, 6:
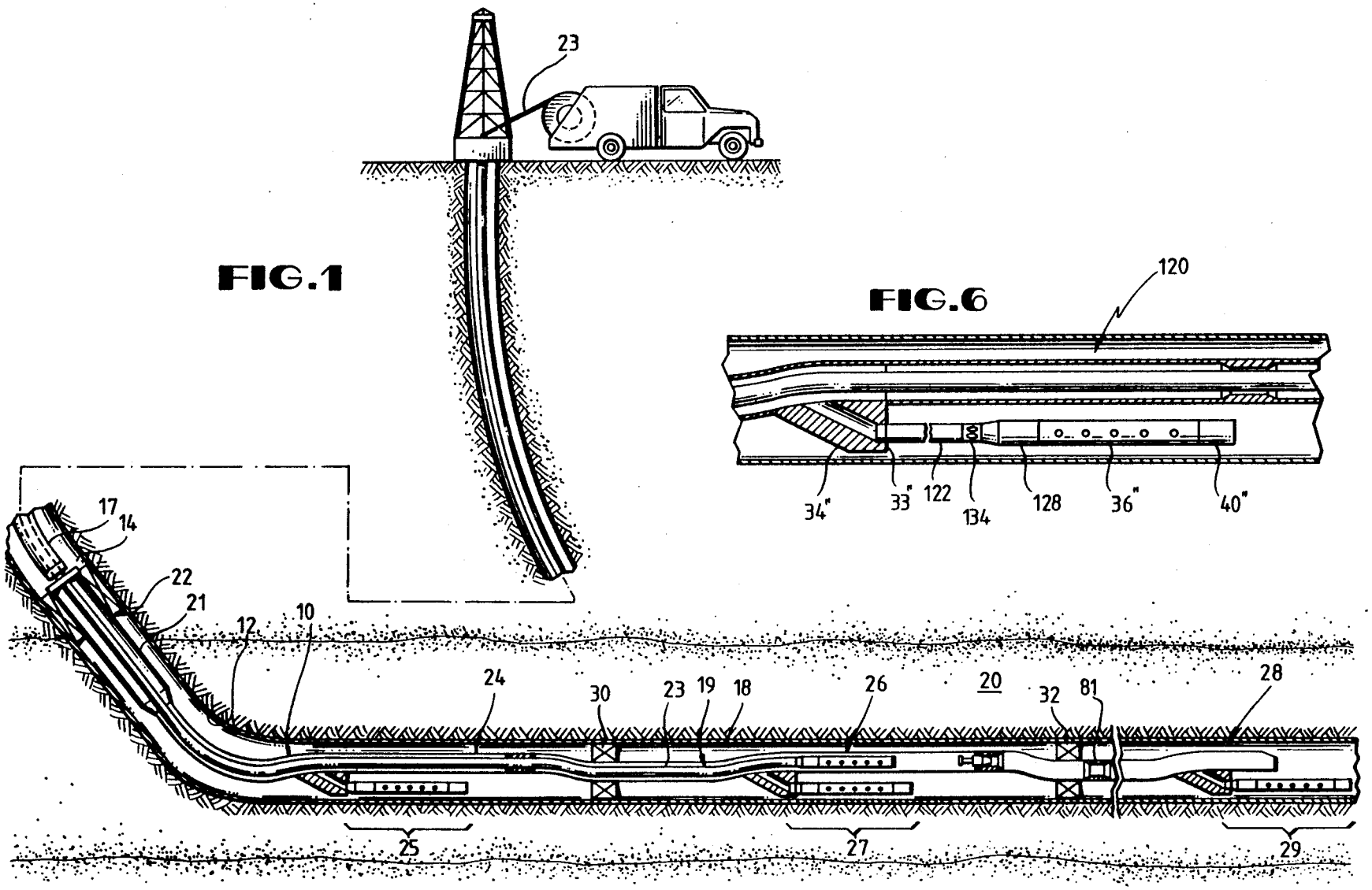
FIG. 1 depicts a deviated wellbore having a bottom hole assembly in accordance with the present invention disposed therein, illustrated partially in vertical section.
FIG. 6 depicts another alternative structure of a perforating gun assembly in accordance with the present invention.

Referring now to the drawings in more detail, and in particular to FIGS. 1 and 2A–C, therein is depicted a primary tool string including an exemplary bottom hole perforating assembly 10 in accordance with the present invention, disposed within a cased wellbore 12. Wellbore 12 is a deviated bore 14 in which casing 16 has been set. The rate of curvature of wellbore 12 has been exaggerated for illustrative purposes. Lower portion 18 of wellbore 12 extends essentially horizontally within a potential production zone 20. As used herein, the term "horizontal wellbore" will refer to any portion of a wellbore which is inclined at 45 degrees or more from vertical. FIG. 1 also depicts a secondary tool string 19 including coiled tubing 23. The function and use of secondary tool string 19 will be described in more detail in reference to FIGS. 3A–C.

Bottom hole perforating assembly 10 includes a packer, preferably a permanent packer assembly 22, and a plurality of perforating gun assemblies 24, 26, 28. Bottom hole perforating assembly 10 is placed in wellbore 12 with perforating gun assemblies 24, 26, 28 adjacent formation intervals 25, 27, 29. Bottom hole assembly 10 will typically be lowered into wellbore 12 on tubing 17. This tubing, as well as the tubing in bottom hole perforating assembly 10, will preferably be large tubing, such as 3.75" or 5.5" diameter tubing. A plurality of isolation packers 30, 32 are individually disposed in bottom hole perforating assembly with one between adjacent perforating gun assemblies 24 and 26, 26 and 28, respectively. Permanent packer assembly 22 will preferably include a polished seal bore 21 for subsequent engagement of tubing, such as production tubing, in a conventional manner. It should be understood that the term "tubing" as used herein may refer to drill pipe, completion tubing, production tubing or other similar tubular members suitable for forming the flow paths described and illustrated herein. Additionally, bottom hole perforating assembly 10 will include appropriate tubing to interconnect permanent packer assembly 22 with the individual perforating gun assemblies 24, 26, 28 and the respective isolation packers 30 and 32. Perforating gun assemblies 24 and 26 are of essentially identical construction. Accordingly, the structure of these perforating gun assemblies will be described relative to perforating gun assemblies 24 and 26 concurrently, with elements of perforating gun assembly 26 indicated in parenthesis "( )". Perforating gun assembly 24 (26) includes a Y block 34 (54) to establish a parallel string having fluid communication with the interior of tubing 17. Coupled to the "branched" leg 33 (53) of Y block 34 (54) is a perforating gun 36 (56) having firing heads 38, 40 (58, 60) at its upper and lower ends respectively. As will be appreciated by those skilled in the art, perforating gun 36 may be one or more individual guns, and may be spaced from Y block 34 (54) by any appropriate length of tubing connected between firing head 38 (58) and Y block 34 (54).

Upper firing head 38 (58) is preferably actuable in response to pressure inside tubing 17. An exemplary firing head of this type is disclosed in U.S. Pat. No. 4,901,802, issued Feb. 20, 1990, to Flint R. George, et al and assigned to the assignee of the present invention. Lower firing head 40 (60) is preferably actuated in response to annulus pressure, and may also be of a conventional type. One exemplary annulus pressure operated firing head suitable for this use is the TDF firing head manufactured and run by Vann Systems, a division of Halliburton Services, used with an annulus/tubing crossover. Each firing head 38, 40 (58, 60) will preferably be a time delay type device which allows a period of time to elapse between the initiation impulse and the detonation of the guns.

Perforating gun 36 (56) will preferably be loaded with individual charges, such as shaped charges, which are oriented to fire and thereby perforate the casing in directions away from an intermediate tubing section, indicated generally at 44 (64), which is attached to the other, "straight", leg 41 (61) of Y block 34. This will prevent the sometimes undesirable perforation of tubing 44 (64) upon detonation of perforating gun 36 (56). Coupled in intermediate tubing section 44 (64) above isolation packer 30 (32) is a seating profile 42 (62). Seating profile 42 (62) may be of any appropriate conventional type, such as an X-1 profile, which is adapted to receive and latchingly engage a plug or standing valve, as will be described later herein.

Figures 2A, 2B, 2C:
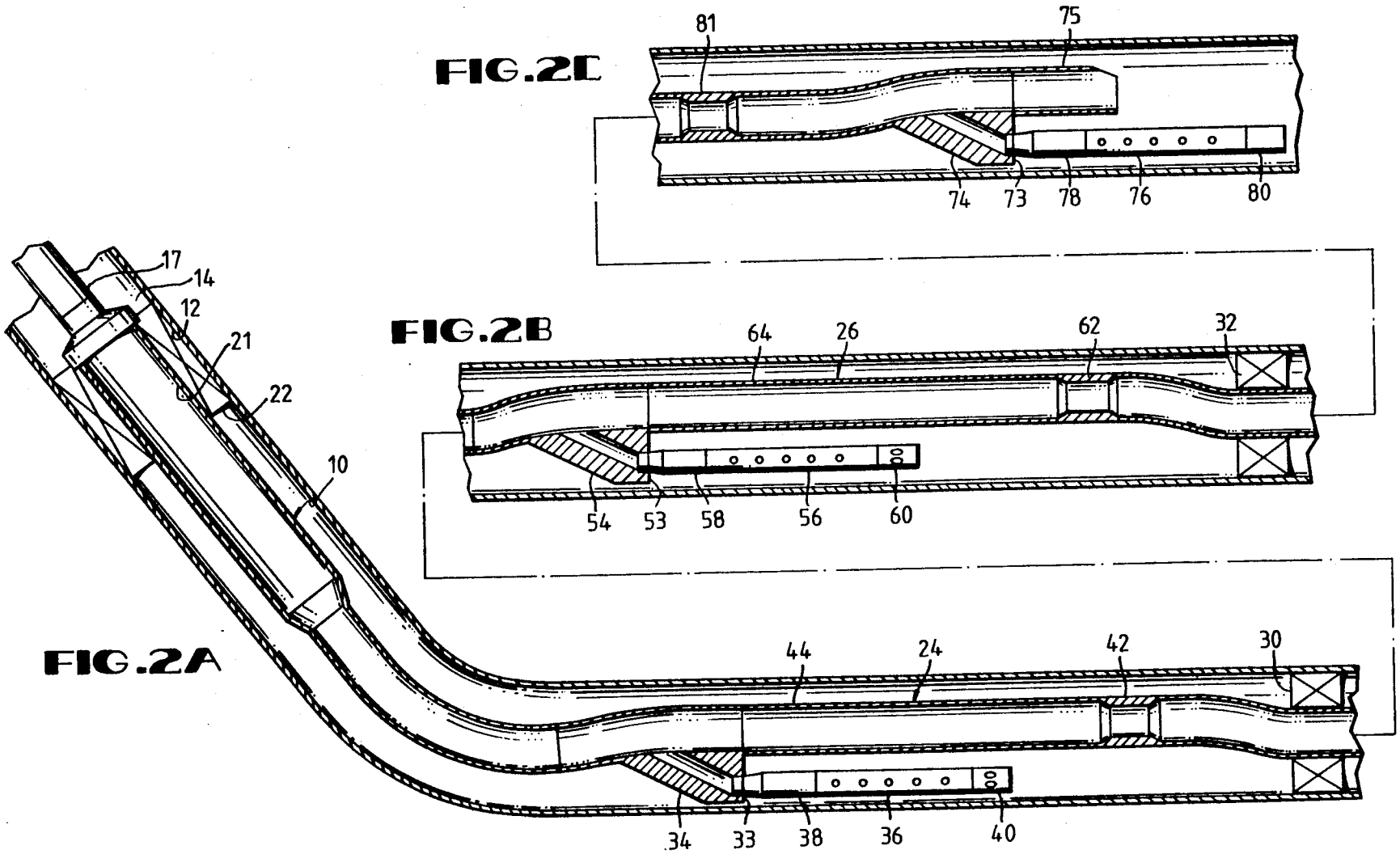
FIGS. 2A–C depicts a bottom hole assembly in accordance with the present invention disposed within a cased borehole, depicted in greater detail and partially in vertical section.

Referring now in particular to FIG. 2C, therein is depicted lower perforating gun assembly 28. Lower perforating gun assembly 28 includes several components which are similar to those found in perforating gun assemblies 24 and 26. As can be seen in FIG. 2C, however, instead of an intermediate tubing section (elements 44 and 64 in FIGS. 2A–B) being coupled to Y block 74, a tail pipe 75 is coupled thereto, thereby providing direct fluid communication between the interior of tubing string 23 and annulus 31 around bottom hole perforating assembly 10. Lower perforating gun assembly 28 includes a profile 81, again such as an X-1 profile, suitable for receiving a plug or standing valve. Lower perforating gun assembly 28 includes a perforating gun 76 having a tubing pressure actuated firing head 78 and an annulus pressure actuated firing head 80, coupled to "branched" leg 73 of Y block 74.

Figures 3A, 3B, 3C:
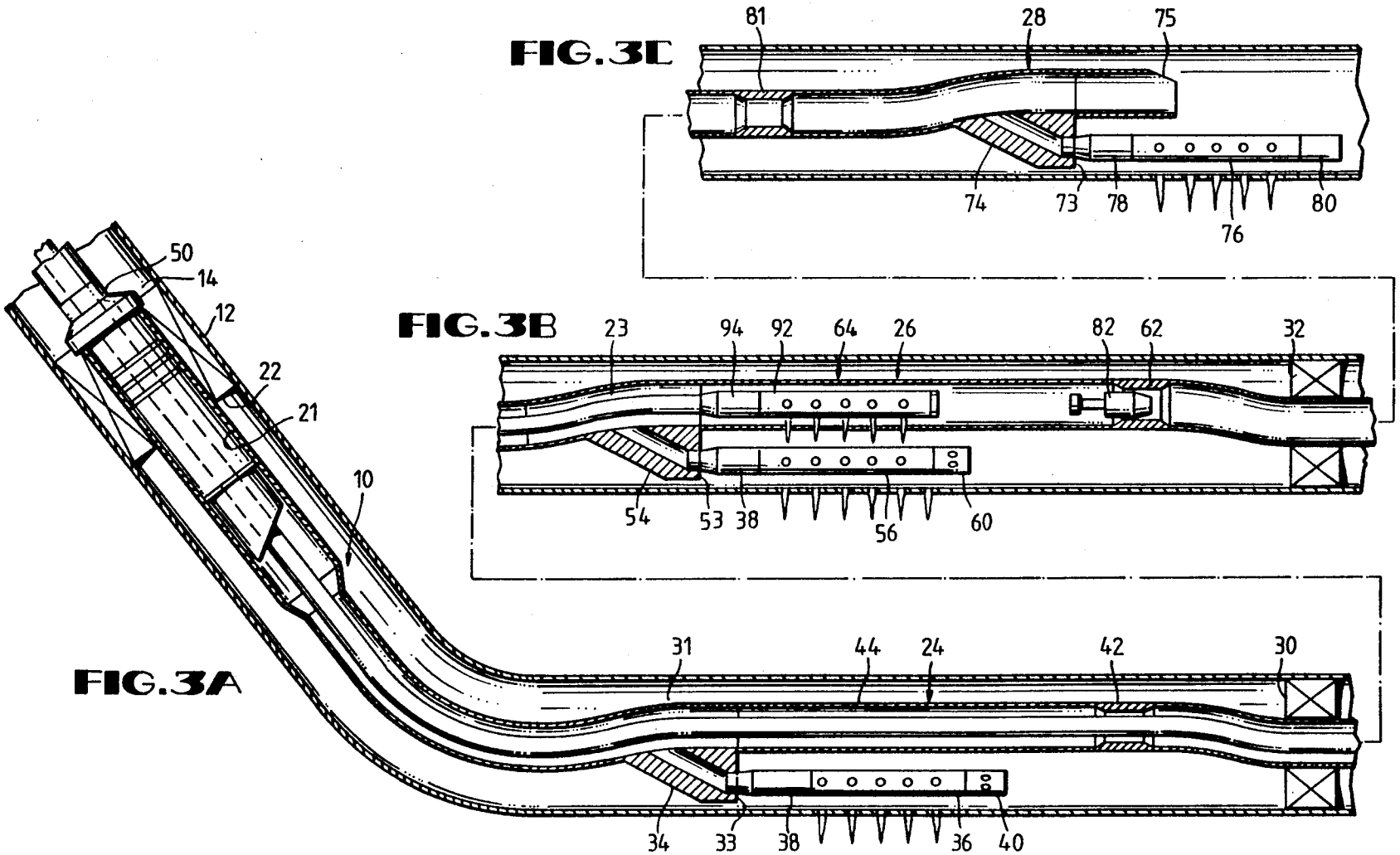
FIGS. 3A–C depict the bottom hole assembly of FIG. 2 with a secondary tool string disposed therein in an exemplary operating configuration.

Referring now to FIGS. 3A–C, therein is shown the bottom hole perforating assembly 10 of FIGS. 1 and 2, which, in this example, has production tubing 50 stabbed into seal bore 80 to complete a production path from permanent packer assembly 22 to the surface. Production tubing is not required to be installed at any particular point in time, however, and its description at this point is as an example of one possible embodiment. Additionally, disposed within production tubing 50 and bottom hole perforating assembly 10 are a check valve or standing valve 82, and a perforating gun, such as a through-tubing perforating gun 92, suspended from coiled tubing 23. Although the description herein will refer to coiled tubing, it should readily understood that snubbing tubing or any appropriately sized tubing to place standing valve 82 and perforating gun 84 in bottom hole perforating assembly 80, could be utilized.

Referring to FIGS. 1–3, an exemplary and preferred method of practicing the method of the present invention is as follows. Bottom hole perforating assembly 10 will be assembled such that when assembly 10 is located at the desired depth within the well, perforating guns 36, 56, 76 will be spaced adjacent the desired intervals 25, 27, 29 in the zone of interest. Once bottom hole perforating assembly 10 has been lowered, typically on tubing, to the desired depth in wellbore 12, permanent packer 22 will be set in a conventional manner. Once permanent packer 22 has been set, pressure will be applied to the interior of tubing 17 to actuate perforating guns 36, 56, 76. As can be seen from FIG. 3, this pressure will be applied through the interior of tubing string 17 to tubing pressure actuated firing heads 38, 58, 78 and will be also applied through the tailpipe 75 of lower perforating gun assembly 28 to the lower annulus 31 surrounding bottom hole assembly 10 underneath packer 22. This pressure in annulus 31 will then act upon annulus pressure operated firing heads 40, 60, 80 of each perforating gun assembly to provide redundant actuation mechanisms for each perforating gun 36, 56, 76. As indicated previously, each firing head 38, 40, 58, 60, 78, 80 will preferably be a time delay type firing head. Where such time delay firing heads are utilized, once the pressure is raised to the actuation pressure, then there will be a sufficient time (such as approximately seven minutes, with one preferred embodiment), for the pressure to be bled down to a desired level. This then allows the perforating guns to perforate formation 20 an underbalance into the interior of tubing string 23, and, to therefore, allow the perforations to be cleaned. The time delay may be provided by an appropriate mechanism, such as by either a pyrotechnic device or a hydraulic delay mechanism. The structure of a suitable pyrotechnic device suitable for use with the present invention is described in U.S. Pat. No. 4,632,034, issued Dec. 30, 1986 to Colle. The specification of U.S. Pat. No. 4,632,034 is incorporated herein.

After a desired flow period, the flow may be stopped by applying pressure to the interior of tubing 17 or by placing a plug or standing valve in lower profile 81. Once a plug or standing valve is placed in profile 81, pressure may be increased to a specified level to set the isolation packers 30, 32. Once isolation packers 30, 32 are set, each perforated interval is isolated from the remaining perforated intervals. Where treatment of an interval is desired, such treatment may now be carried out on each individual interval. Such treatment may include acidizing, fracturing, etc; or formation control operations; such as the placement of sand and/or resin coated sand into the perforations to control formation deterioration or extrusion. For example, if it is desired to acidize the lowermost zone, acid may then be pumped through tubing 23 into the perforations in lowest perforated interval 29. Once the acidizing (or other treatment operation), is complete, the interval may either be placed on production; or the interval may be shut-in, and additional, higher, intervals may be treated.

For example, if it is desired to acidize intermediate interval 27, coiled tubing may be run into the hole to place a standing valve 90, or plug, in profile 62 to isolate intermediate interval 27 for treatment. Once standing valve 90 is in place, coiled tubing with a perforating gun 92, attached thereto, would preferably be lowered through tubing 17 and into bottom hole perforating assembly 10 to a depth where perforating gun 92 is approximately adjacent perforating gun 56 of perforating gun assembly 26. Alternatively, a standing valve 82 and perforating gun 92 may be placed in the hole in one trip. In such instance, standing valve 82 could be utilized to locate perforating gun 92 within bottom hole assembly 10. Through tubing perforating gun 94 may then be actuated such as by application of tubing pressure upon a tubing pressure actuated firing head 94 to perforate tubing section 64. As can be seen in FIGS. 3A–C, once standing valve 90 is in place within profile 62, there is no flow path into the interior of tubing string 50 until the actuation of perforating gun 92. Once perforating gun 92 is actuated and tubing section 64 is perforated, then flow may pass from intermediate interval 27 into tubing string 50. Through tubing perforating gun 92 may be loaded with charges and oriented such that perforations will be directed to the sides and toward perforating gun 56. Alternatively, through-tubing perforating gun 92 may be utilized to perforate not only intermediate tubing section 64 but also to repreforate casing 16 in all directions proximate interval 27. With standing valve 90 in place, treatment may be performed on intermediate interval 27 through tubing string 23 with the fluid communication area isolated between isolation packers 30 and 32. Such isolation of intervals for treatment assures optimal control over the treatment operation. If all zones were to be treated simultaneously, such as by acidizing, it is possible that one interval could take fluid more rapidly then the others, resulting in inadequate treatment of these intervals. Similar treatments may be performed upon upper interval 25 adjacent perforating gun assembly 24, in a similar manner, beginning by placing a standing valve in profile 42.

Figure 4:
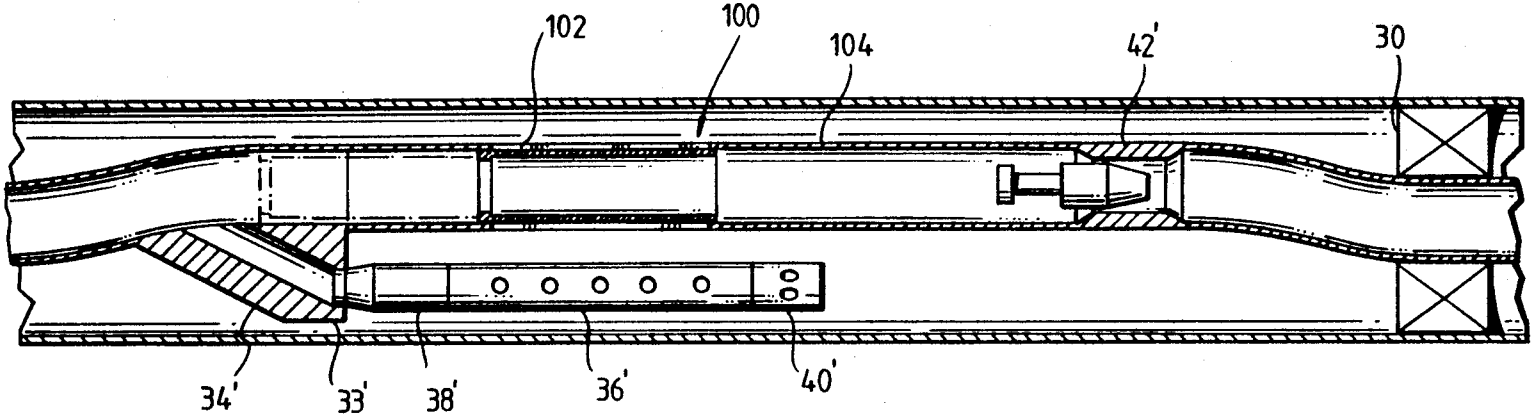
FIG. 4 depicts an alternative structure for a perforating gun assembly portion of the bottom hole perforating assembly of FIG. 2 illustrated partially in vertical section.

Referring now to FIG. 4, therein is depicted an alternative structure of a perforating gun assembly 100. Many of the components in perforating gun assembly 100 are essentially identical to those identified in perforating gun assembly 24, and are, therefore, identified with corresponding primed numbers. The difference of perforating gun assembly 100 from perforating gun assemblies 24 and 26 is that perforating gun assembly 100 includes a sliding sleeve valve assembly 102 adjacent a tubing section 104. Sliding sleeve valve assembly 102 is preferably a mechanically-actuated valve, although pressure-actuated valves would be suitable for use with the some embodiments and applications of present invention. One exemplary mechanically-actuated valve is the Model XO manufactured and run by Otis Engineering Corporation. Sliding sleeve valve 102 allows the selective opening or closing of fluid communication between the annulus adjacent the perforated interval and the interior of tubing string 17. Thus, the use of sliding sleeve valves, while still typically requiring the trip into the hole with coiled tubing to actuate the valves, would eliminate the requirements of a through tubing perforating gun (element 92 in FIG. 3), and would eliminate the requirement of perforating a tubing section in the upper perforating gun assemblies to facilitate fluid flow into tubing string 17.

Figure 5:
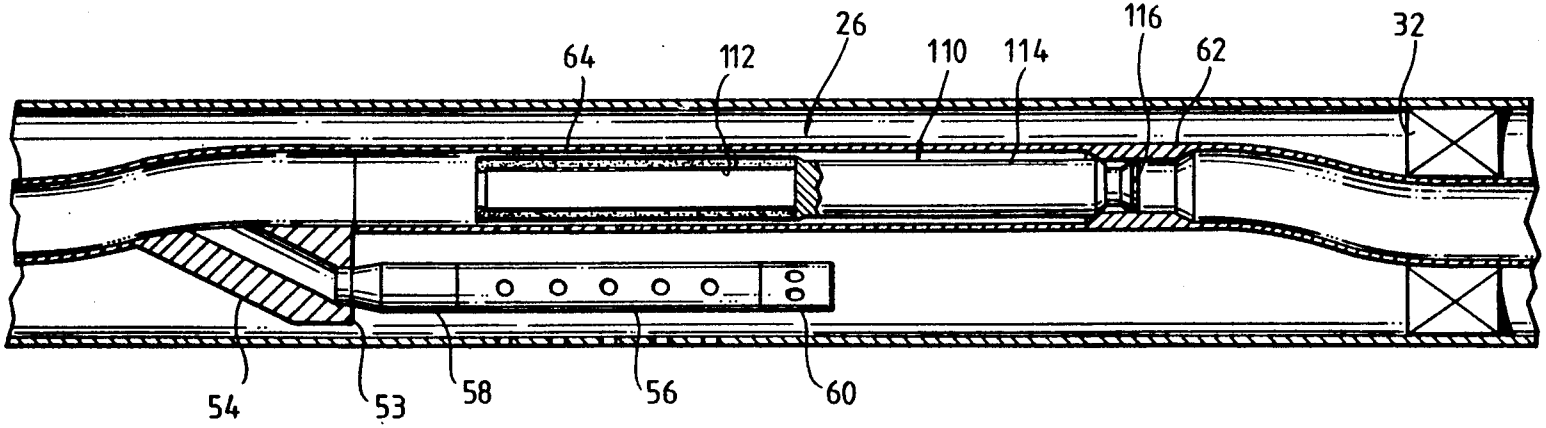
FIG. 5 depicts another alternative embodiment for a perforating gun assembly portion of the bottom hole assembly of FIG. 2, also illustrated partially in vertical section.

Referring now to FIG. 5, therein is depicted an apparatus suitable for sand control on one or more of the intervals perforated through use of methods and apparatus in accordance with the present invention, such as through use of bottom hole assembly 10. As previously depicted in FIGS. 2 and 3, only intermediate perforating gun assembly 26 is depicted herein. A sand control apparatus 110 is depicted as being lowered into bottom hole assembly 10 proximate perforating gun assembly 26. Sand control assembly comprises a prepacked screen 112 coupled to a locating pipe 114, having a latching sub 116 attached at the bottom thereof. Latching sub 116 is adapted to engage profile 62 and to latch therein. Locating pipe 114 is of an appropriate length so as to locate prepacked screen 112 adjacent the perforations in tubing section 44. Latching sub 116 and locating pipe 114 are adapted to allow internal fluid flow, such that engagement of latching sub 116 with profile 62 does not preclude fluid flow from a lower isolated interval. Prepacked gravel screen may be chosen from a variety of conventional types, requiring only that it be able to pass through obstructions in the tubing string, such as, for example any upward-lying profiles (such as element 44 in FIG. 2).

Referring now to FIG. 6, therein is depicted an alternative structure of a perforating gun assembly 120 in accordance with the present invention. Bottom hole perforating assembly 120 includes all elements depicted in perforating gun assembly 24 of FIGS. 1–3. Accordingly, those elements are depicted here with corresponding double primed numbers. In addition to the previously depicted elements, perforating gun assembly 120 includes a surge chamber 122. The use of surge chambers facilitates the conduct of perforating multiple intervals with an underbalance while maintaining all intervals isolated from one another at the time of perforation. Surge chamber 122 may be coupled at any appropriate location, but preferably is coupled in the "branched" leg from each Y-block and is therefore depicted as attached directly to the branched leg 43" of Y-block 34" above tubing pressure actuated firing head 128 and each perforating gun 36". Each tubing pressure-actuated firing head 128 preferably also includes a sliding sleeve assembly adapted to open upon actuation of the firing head. Thus, actuation of each firing head essentially simultaneously opens a valve 134. Firing heads of this type are disclosed in U.S. Pat. No. 4,862,964 issued Sept. 5, 1989 to Flint R. George, et al. The specification of U.S. Pat. No. 4,862,964 is hereby incorporated herein by reference for all purposes.

The present invention contemplates other alternative embodiments. For example, where there would be no anticipated need treat individual formation zones, or to maintain selective control of flow across the length of the bottom hole assembly, the bottom assembly would then not need to include isolation packers 30, 32. Additionally, instead of having single Y block perforating gun assemblies 24, 26 as depicted herein, double Y block perforating assemblies providing redundant firing mechanisms which are both actuable in response to tubing pressure could be utilized. Such double Y-block assemblies are disclosed in U.S. Pat. No. 4,901,802, incorporated by reference earlier herein.

Many modifications and variations may be made in the techniques and structures described and illustrated herein without departing from the spirit and scope of the present invention. Accordingly, the embodiments described and illustrated herein are illustrative only, and are not to be taken as limitations upon the scope of the present invention.

What is claimed is:

1. A method of perforating multiple intervals in a well, comprising the steps of:

establishing a tool string in a well, said tool string comprising:

a primary tubing string, a first packer assembly coupled to said tubing string, a plurality of perforating gun assemblies, each perforating gun assembly comprising:

a branching block coupled to said tubing string, a perforating gun coupled said branching block, and a first firing head operably coupled to said perforating gun;

setting said first packer assembly to isolate an upper portion of said well bore from a lower portion of said well bore, said lower portion of said well bore being in fluid communication with the interior of said tubing string;

applying pressure to the inteior of said tubing string to actuate said perforating guns in said plurality of perforating gun assemblies to perforate said well;

lowering a secondary tubing string having a secondary perforating gun attached thereto inside said primary tubing string to locate said perforating gun proximate a previously perforated interval; and actuating said secondary perforating gun to perforate said primary tubing string to establish a flow path between said perforated formation and the interior of said primary tubing string.

2. The method of claim 1, wherein said tool string further comprises a second packer, said second packer disposed in said tool string between two perforating gun assemblies of said plurality of perforating gun assemblies, and wherein said method further comprises the step of setting said second packer to isolate a portion of the annulus adjacent one perforating gun assembly from a portion of the annulus adjacent another of said perforating gun assemblies.

3. The method of claim 1, further comprising the step of placing a sand control mechanism inside at least one of said perforating gun assemblies after said step of actuating said secondary perforating gun to perforate said primary tubing string.

4. The method of claim 1, wherein at least one of said plurality of perforating gun assemblies further comprises a surge chamber, the interior of which is in fluid communication with the exterior proximate the time of the actuation of said perforating gun in said perforating gun assembly.

5. A method of perforating multiple intervals in a well, comprising the steps of:

establishing the tool string in a well, said tool string comprising:

a tubing string;

a first packer assembly coupled to said tubing string;

a plurality of perforating gun assemblies, each perforating gun assembly comprising:

a branching block coupled to said tubing string, a perforating gun coupled to said branching block; and a first firing head operably coupled to said perforating gun, and a flow control valve to selectively allow fluid communication between said tubing string and the area surrounding said perforating gun assembly;

setting said first packer assembly to isolate an upper portion of said well bore from a lower portion of said well bore, said lower portion of said well bore being in fluid communication with the interior of said tubing string;

applying pressure to the interior of said tubing string to actuate said perforating guns in said plurality of perforating gun assemblies to perforate said well;

lowering a secondary tubing string having a flow control valve operating mechanism attached thereto into said well;

actuating said flow control operating mechanism to open said flow control valve to establish fluid communication between said tubing string and said area surrounding said perforating gun assembly.

6. The method of claim 5, wherein at least one of said plurality of perforating gun assemblies includes a profile adapted to receive a flow control mechanism, said method further comprising the step of placing a flow control mechanism in said profile.

7. The method of claim 5, wherein said tool string further comprises at least one isolation packer disposed in said tool string between two of said plurality of perforating gun assemblies, and wherein said method further comprises the step of setting said isolation packer to isolate a portion of the annulus adjacent one perforating gun assembly from a portion of the annulus adjacent another of said perforating gun assemblies.

8. The method of claim 5, further comprising the step of placing a sand control mechanism inside said perforating gun assembly.

9. An apparatus for perforating multiple intervals in a well, comprising:

a tool string, said tool string comprising:

a bottom hole assembly, said bottom hole assembly comprising:

a first packer assembly, and a plurality of perforating gun assemblies, each perforating gun assembly comprising:

a branching block coupled to said tubing string, a perforating gun coupled to said branching block, and a first firing head operably coupled to said perforating gun, and at least one isolation packer disposed in said tool string between two of said plurality of perforating gun assemblies; and a secondary tubing string sized and configured to be run into said primary tool string, said secondary tubing string including a secondary perforating gun adapted to selectively perforate portions of said bottom hole assembly.

10. The apparatus of claim 9, wherein at least one of said perforating gun assemblies further comprises a second firing head operably to said perforating gun.

11. The apparatus of claim 9, wherein said secondary tubing string comprises coiled tubing.

12. The apparatus of claim 9, wherein said apparatus further comprises a sand control mechanism adapted to be placed in one of said perforating gun assemblies by said secondary tubing string.

* * * * *